United States Patent [19]

Edwards

[11] Patent Number: 4,729,745

[45] Date of Patent: Mar. 8, 1988

[54] QUICK RELEASE ASSEMBLY FOR ELECTRIC TROLLER MOTORS

[75] Inventor: James R. Edwards, Dubuque, Iowa

[73] Assignee: The Eska Company, Dubuque, Iowa

[21] Appl. No.: 884,534

[22] Filed: Jul. 11, 1986

[51] Int. Cl.[4] ..... B63H 5/12

[52] U.S. Cl. ..... 440/6; 248/642; 440/55

[58] Field of Search ..... 440/6, 7, 55; 248/640, 248/642, 643; 292/302; 403/315

[56] References Cited

U.S. PATENT DOCUMENTS 2,789,849 4/1957 Hughes ..... 292/302

3,604,674 9/1971 Wilkerson ..... 248/642

*Primary Examiner*—Sherman D. Basinger

*Attorney, Agent, or Firm*—James C. Nemmers

[57] ABSTRACT

A quick release assembly for electric troller motors of the type having a motor-propeller assembly supported at the lower end of a vertical motor tube and control and starting functions supported on the tube at the upper end. The motor tube is held in a swivel bracket that in turn is operatively connected to the mounting bracket secured to the bow or transom of the boat. A quick release pin provides one pivot for the connection between the swivel bracket and the mounting bracket, while a thrust pin provides the other connection with a moveable retainer plate allowing quick release of the swivel bracket from the mounting bracket after the quick release pivot pin is removed.

3 Claims, 2 Drawing Figures

42
34
14
48
50
44
32
48
46
50
38
40
36
36
38
24
40
33
28
31
30

QUICK RELEASE ASSEMBLY FOR ELECTRIC TROLLER MOTORS

BACKGROUND OF THE INVENTION

In recent years, the use of electric trolling motors for fishing has become increasingly popular. Normally, the electric trolling motor is used on the same boat with the main outboard motor, the latter being used to move the boat to a fishing area when it is turned off and the electric trolling motor used. When this combination of motors is used on a single boat, it is common to mount the electric trolling motor on the bow of the boat, although it can also be mounted on the transom at the rear of the boat.

When mounted on the bow of the boat, the bow mounting bracket and assembly is usually permanently affixed to the bow of the boat and commonly permits the trolling motor to be pivoted to a horizontal position out of the water and on the bow of the boat when not in use.

Frequently, it is desirable to remove the electric trolling motor from the bow mount assembly for safe storage. Since the electric trolling motor consists commonly of a vertical motor tube with a motor-propeller unit secured to the lower end and the control housing at the upper end, it generally is not an easy task to remove the troller motor assembly from the mounting bracket. Frequently, separation of the troller motor assembly from the mounting assembly involves the removal of several pins or other fasterners and is a tedious task that is not quickly and conveniently performed.

There is therefore a need for a connecting means between the troller motor assembly and the mounting assembly that will permit the two assemblies to be quickly and easily separated when desired. Preferably, the quick release separation should be accomplished without the use of any tools and must not interfere with the other components of the structure which are essential to proper operation of the electric trolling motor. Such a quick release feature should be simple to use and should not add significantly to the cost of the unit.

SUMMARY OF THE INVENTION

In the invention, the motor tube that interconnects the motorpropeller unit at its lower end with the control unit at its upper end is affixed to a swivel bracket that holds the motor assembly at a predetermined height and also provides for turning of the motor in order to provide the steering function. Also, the mounting structure of the invention preferably has a break away feature which permits the motor-propeller unit to ride up over a submerged object if struck while the boat is in motion. The structure of the invention therefore provides two pivot pins, a lower pivot pin which interconnects the swivel bracket and the mounting bracket and an upper pivot pin which preferably forms a part of the break away feature. In any event, the lower pivot pin is provided with a quick release mechanism so that it can be quickly and easily withdrawn without the use of tools. The upper pivot pin connects the mounting bracket to the motor swivel bracket by use of a moveable retainer plate that is spring biased into a locked position. By merely moving the swivel plate against the bias of the spring, the motor swivel bracket can be released from the upper pivot pin. Thus by merely removing one pin and releasing the other, the entire motor assembly can be separated from the mounting structure quickly and easily.

DESCRIPTION OF THE PREFERRED EMBODIMENT OF THE INVENTION

Figure 1:
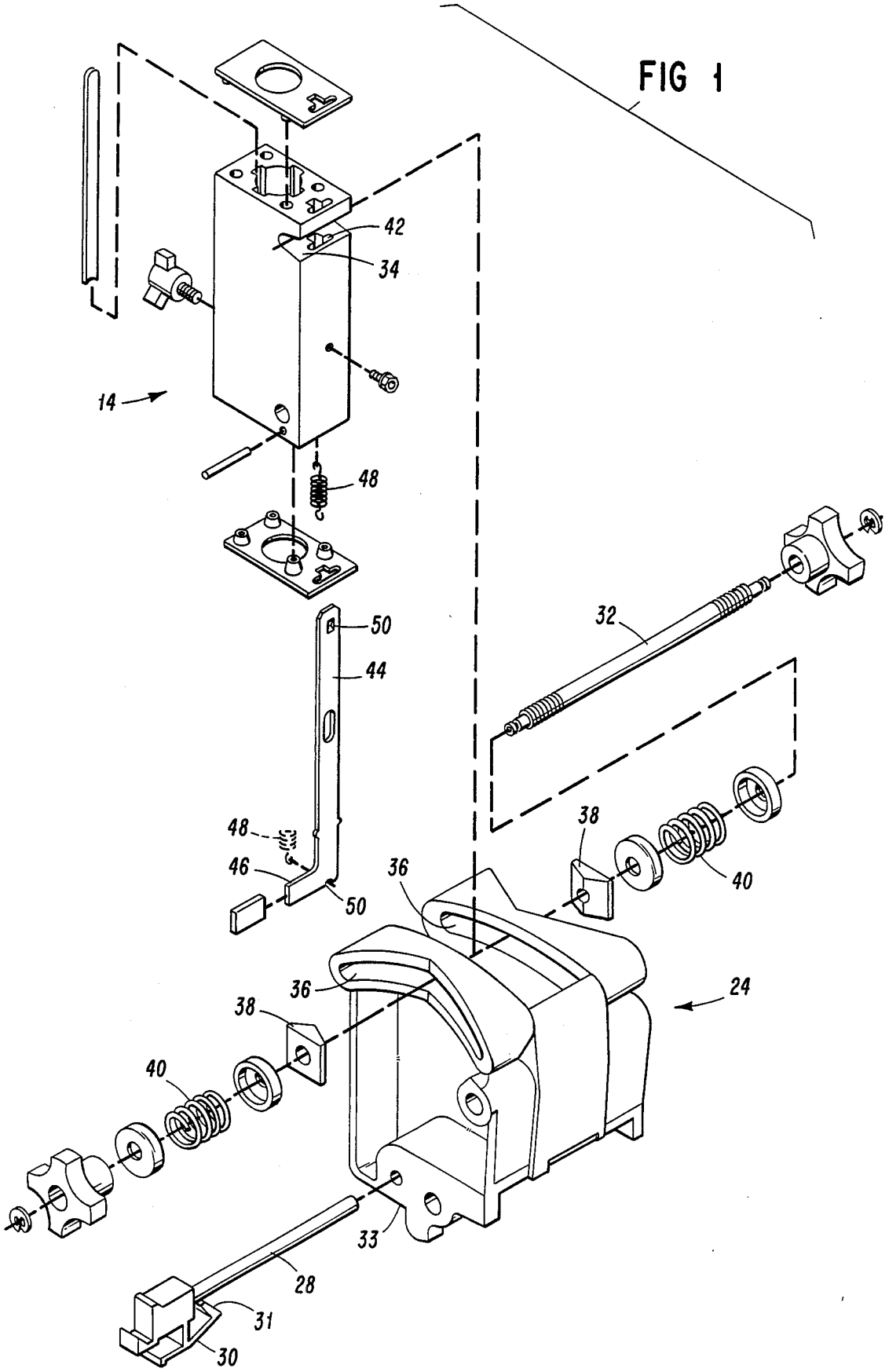
FIG. 1 is an exploded perspective view illustrating the interconnection between the motor assembly and the mounting structure.

In the drawings there is illustrated an electric trolling motor and propeller assembly 10 affixed to the lower end of an elongated motor tube 12 which extends through and is held by a swivel mounting bracket 14. As is well known to those skilled in the art, at the upper end of the motor tube 12 would be a housing containing controls for supplying power to drive the motor 10 and to the turn the motor 10 and tube 12 so as to steer the boat to which the motor assembly is secured.

Figure 2:
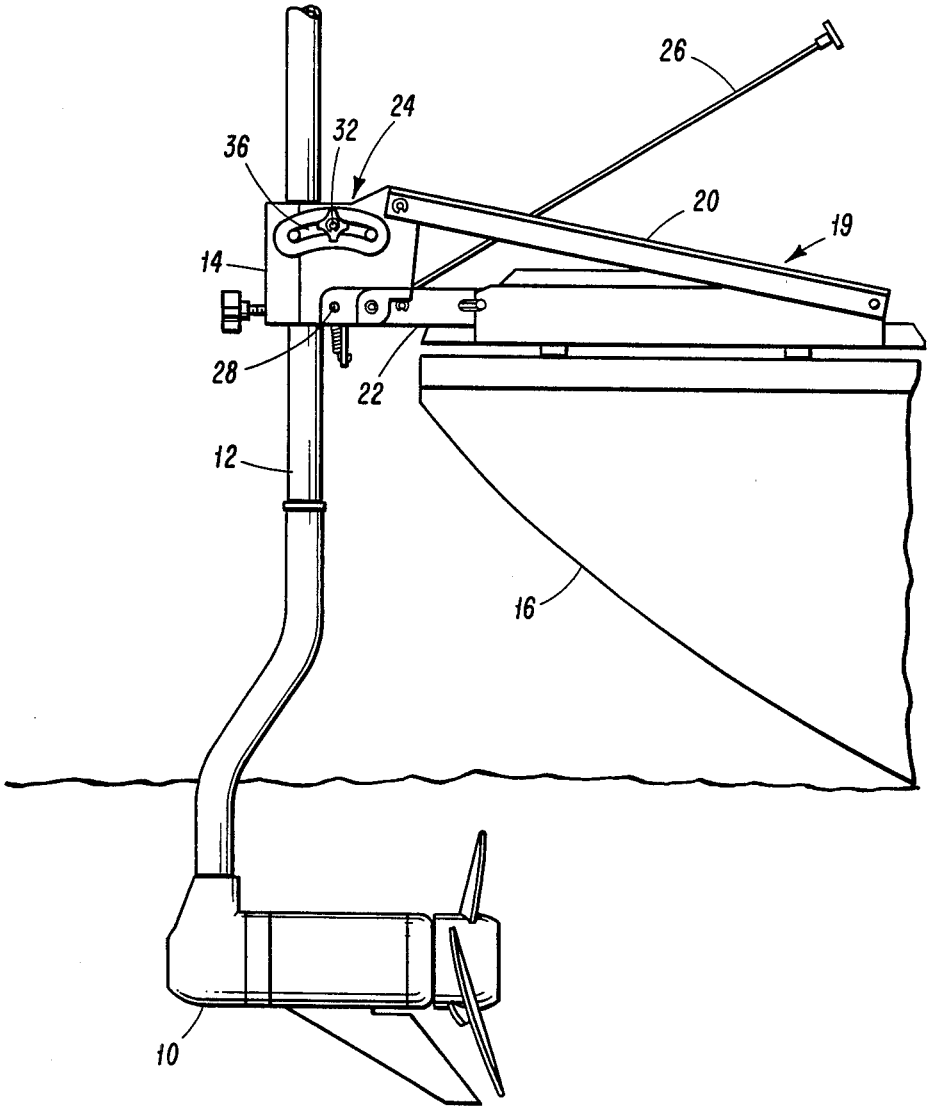
FIG. 2 is a side elevational view showing the motor assembly and mounting structure in their assembled condition and in motor operating position.

The bow 16 of a boat contains a bow-mount bracket assembly indicated generally by the reference numeral 19. These assemblies can be of a variety of designs, but generally include an arrangement which has a pair of upper support arms 20 and a lower arm 22 pivotally secured at their outer ends to a mounting bracket indicated generally by the reference numeral 24. The bow mount assembly 19 is customarily designed so that the motor-prop assembly 10 can be swung to the operating position shown in FIG. 2, and when the electric trolling motor is not in use, the motor assembly 10 and its associated structure can be pivotally swung to a storage position by pulling a cord and handle assembly 26 upwardly so that the motor 10 and motor tube 12 will rest in a generally horizontal storage position on the bow 16 of the boat.

The swivel mounting bracket 14 that supports the motor tube 12 and the motor-propeller assembly 10 is pivotally secured to the mounting bracket 24 by a lower pivot pin 28 that extends through the lower inside corner of the swivel mounting bracket 14. This is clearly shown in FIG. 1. At the outer end of one end of the pivot pin 28 is a fingergripping handle 30 which allows the pivot pin 28 to be inserted and removed manually. Pivot pin 28 may be inserted through the bracket 14 from either the left or right side. When in place securing the mounting bracket 24 to the swivel mounting bracket 14, the pivot pin 28 will be held in place by an integral latch 31 that engages beneath and behind the lower edge 33 of the mounting bracket 14.

The mounting bracket 24 is also provided with a thrust pin 32 that extends through a slot 34 in the upper inside corner of the swivel mounting bracket 14 and also through slots 36 on each side of the mounting bracket 24. The thrust pin is combined with thrust pads 38 and springs 40 which provide a break away feature in the event that the motor-propeller assembly 10 should strike a submerged object. This is all more fully described in my co-pending U.S. patent application Ser. No. 884,536, filed July 11, 1981 and entitled "Break Away Mounting Structure for Electric Trolling Motors" and does not form a part of the invention described herein. Obviously, the invention described herein is adaptable to a variety of different types of mounting structures, and could work with a fixed upper pivot pin that would be a shear pin.

Referring especially to FIG. 1, it will be seen that the swivel mounting bracket is provided with a vertical slot 42 through which there extends a retaining member 44 which has an offset portion 46 at its lower end that provides a grip for the operator to move the retaining member downwardly against the bias of a spring 48 that is connected at one end to the lower surface of the mounting bracket 14 and at the other end in a slot 50 on the lower end of the retaining member 44. Spring 48 thus biases the retaining member 44 upwardly so that it passes through the slot 34 and serves to retain the thrust pin 32 in the slot 34. Preferably, retaining member 44 has an integral angled stop 50 which engages thrust pin 32, thus eliminating any gap between member 44 and pin 32. However, when the offset portion 46 is gripped and pulled downwardly against the bias of spring 48, the retaining member 44 can be moved downwardly a sufficient amount so that the outer end of slot 34 will be opened to permit the swivel mounting bracket 24 to be disengaged from the thrust pin 32.

Thus, when the motor assembly carrying the swivel mounting bracket 14 is connected to the mounting bracket assembly 19, the motor assembly will be positioned with the respective openings in mounting bracket 14 aligned with the openings in the mounting bracket 24. The lower pivot pin 28 can then be inserted, and with the retaining member pulled downwardly so as to open the end of slot 34 at the upper end of the mounting bracket 14, the motor assembly can be pivoted on pin 28 until the slot 34 engages over the thrust pin 32. The retaining member 44 can then be released, and the spring 48 will bias the retaining member 44 upwardly locking the thrust pin 32 in the slot 34 and locking the motor assembly to the mounting assembly. In order to simply and quickly separate the motor assembly from the mounting bracket assembly 19, the operator merely needs to grip the offset portion 46 and move the retaining member 44 downwardly against the bias of spring 48 until the retaining member 44 clears the slot 34 thus allowing the mounting bracket 14 to be disengaged from the thrust pin 32. The operator then grips the handle 30 on the pivot pin 28 and removes the pin to completely separate the motor assembly from the mounting bracket assembly. Obviously, this can be done quickly and simply and without the use of tools. When the two assemblies are in fact separated so that the motor assembly can be separately stored or stowed away, the pivot pin 28 is preferably returned to its position in the mounting bracket 24 so that it is not lost. Thus, there are no fasteners to remove that would require tools and the assembly and disassembly process can be done in a matter of seconds.

Having thus described the invention in connection with the preferred embodiment thereof, it will be evident to those skilled in the art that various revisions and modifications can be made to the preferred embodiment disclosed herein without departing from the spirit and scope of the invention. It is my intention however that all such revisions and modifications as are evident to those skilled in the art will be included within the scope of the following claims.

What is claimed is:

1. A mounting structure for an outboard motor for boats comprising a mounting assembly for attaching the motor to the boat, a bracket for supporting the motor, a first connection between the bracket and the mounting assembly, said first connection including a manually removeable pivot pin interconnecting the bracket and the mounting assembly, a second connection between the bracket and mounting assembly, said second connection including a slot in the bracket open toward the mounting assembly, a thrust pin in the mounting assembly engageable in the slot, a manually releaseable latch moveable across the open end of the slot to a locked position to normally close the slot and hold the thrust pin engaged in the slot, said bracket having a vertically extending guide opening in which the latch moves, means biasing the latch to the normally closed locked position, and a cam surface on said latch that engages the thrust pin when the latch is in the normally closed locked position so as to seat the thrust pin tightly in the slot, said first and second connections providing for total separation of the bracket from the mounting assembly by releasing the latch and removing the pivot pin.

2. A mounting structure for an outboard motor for boats comprising a mounting assembly for attaching the motor to the boat, a bracket for supporting the motor, a first connection between the lower end of the bracket and the lower end of the mounting assembly, said first connection including a manually removeable pin connecting the bracket and the mounting assembly, and a second connection between the upper end of the bracket and the upper end of the mounting assembly, said second connection including a slot in the bracket open toward the mounting assembly, a thrust pin in the mounting assembly engageable in the slot, a manually releaseable latch that is normally in a locked position closing the slot so as to maintain the thrust pin engaged in the slot and means biasing the latch to the normally closed position, said first and second connections providing for total separation of the bracket from the mounting assembly by releasing the latch and removing the pivot pin.

3. The mounting structure of claim 2 in which said latch is provided with a cam surface engageable with the thrust pin when the latch is in the locked position so as to seat the latch pin tightly in the slot.

* * * * *